US006484960B1

(12) United States Patent
Ono

(10) Patent No.: US 6,484,960 B1
(45) Date of Patent: Nov. 26, 2002

(54) COIL WINDING MACHINE AND METHOD OF PRODUCING DEFLECTION COIL

(75) Inventor: Akira Ono, Kanagawa (JP)

(73) Assignee: Sony Corporation (JP)

( * ) Notice: Subject to any disclaimer, the term of this patent is extended or adjusted under 35 U.S.C. 154(b) by 48 days.

(21) Appl. No.: 09/689,754

(22) Filed: Oct. 13, 2000

(30) Foreign Application Priority Data

Oct. 20, 1999 (JP) ..... 11-297573

(51) Int. Cl.[7] ..... H01F 41/06
(52) U.S. Cl. ..... 242/437; 242/439
(58) Field of Search ..... 242/437, 437.1, 242/437.2, 437.3, 437.4, 439, 440, 440.1; 29/605

(56) References Cited

U.S. PATENT DOCUMENTS

| | | | | | |
|---|---|---|---|---|---|
| 5,419,503 | A | * | 5/1995 | Watanabe | 242/437.3 |
| 5,484,113 | A | * | 1/1996 | Watanabe | 242/437.3 |
| 5,573,200 | A | * | 11/1996 | Sato | 242/434.8 |
| 5,622,331 | A | * | 4/1997 | Kosaka | 242/437.3 |
| 5,775,626 | A | * | 7/1998 | Ono | 242/437 |
| 5,845,863 | A | * | 12/1998 | Takubo | 242/437.1 |
| 5,988,554 | A | * | 11/1999 | Taka | 242/433.1 |
| 6,029,925 | A | * | 2/2000 | Yano | 242/440.1 |

FOREIGN PATENT DOCUMENTS

| | | | |
|---|---|---|---|
| EP | 0766282 A2 | * | 4/1997 |
| JP | 409-153427 A | * | 6/1997 |

* cited by examiner

*Primary Examiner*—Kathy Matecki
(74) *Attorney, Agent, or Firm*—Rader, Fishman, & Grauer PLLC; Ronald P. Kananen, Esq.

(57) ABSTRACT

The coil winding machine includes bobbin holding means for holding a coil bobbin having at each end portion a circumferential guide groove, a nozzle for feeding out a conducting wire for a deflection coil, the nozzle being movable along the inner peripheral surface of the coil bobbin, and a winding guide for restricting the position of the conducting wire. The winding guide has a tip portion movable in and out of the circumferential guide groove of the coil bobbin. The tip portion has a stepped portion capable of being engaged/disengaged with/from the conducting wire due to the relative positional relationship between the stepped portion and the nozzle in the center axial direction of the coil bobbin and a guide portion for restricting the feeding position of the conducting wire released from the stepped portion. With this configuration, since the conducting wire can be accurately positioned at a desired winding position in each slit of the coil bobbin, it is possible to reduce variations in winding position between the conducting wire portions wound in the slit and, hence, to increase the accuracy of a winding distribution of the deflection coil.

5 Claims, 8 Drawing Sheets

51
52
53
54
W

COIL WINDING MACHINE AND METHOD OF PRODUCING DEFLECTION COIL

BACKGROUND OF THE INVENTION

The present invention relates to a coil winding machine suitably used to wind a conducting wire of a deflection coil on a coil bobbin in a saddle type and a method of producing a deflection coil by using the coil winding machine.

In color cathode ray tubes (hereinafter, referred to as "color CRTs"), three electron beams emitted from an electron gun are deflected in the vertical and horizontal directions to display a color image on a screen.

A deflection yoke having a horizontal deflection coil and a vertical deflection coil is used for deflecting electron beams.

The deflection yoke is mounted on a cone portion extending from a neck portion and a funnel portion of a CRT.

The deflection yoke forms a deflection magnetic field by making a horizontal deflection current flow in the horizontal deflection coil and also making a vertical deflection current flow in the vertical deflection coil, to deflect electron beams in the vertical and horizontal directions by the deflection magnetic field.

The three electron beams thus deflected are converged at one point of a color selection electrode (aperture grill or shadow mask), thereby to reproduce a desired color image on the screen.

By the way, in recent years, there have been strong demands toward higher accuracy of TV sets, computer displays, and the like.

In particular, to realize the enlargement of a display screen for TV sets and also realize the display of high-definition images for computer displays, the deflection frequency of electron beams has become increasingly higher.

Further, to reduce distortion and unnecessary reflection from the exterior at a peripheral portion of the screen of a CRT, flattening of the panel of the CRT has been developed.

A CRT having a flattened panel (hereinafter, referred to as "flat panel CRT"), however, has an inconvenience that since the distance between a deflection yoke and each of the right and left ends becomes longer, it becomes very difficult to ensure the convergence of electron beams in combination of reduction in raster distortion only by a deflection distribution generated by the deflection yoke.

At present, TV sets and computer displays using flat panel CRTs have been commercially available.

In such a flat panel CRT, however, if the convergence of electron beams in combination of reduction in raster distortion cannot be obtained only by a deflection magnetic field generated by a deflection yoke, it must be realized by using a complicated correction circuit or performing difficult adjustments.

On the other hand, from the viewpoint of electric characteristic, as the number of turns of a conducting wire of a deflection coil becomes larger, it becomes harder for a current with a high frequency to flow in the conducting wire.

Accordingly, to increase a deflection frequency of electron beams, it is required to reduce the number of turns of a conducting wire of a deflection coil.

The reduction in the number of turns of a conducting wire means that the field strength per one turn of the conducting wire becomes large to raise the sensitivity.

As a result, a deviation in winding position of a conducting wire exerts a large effect on the deflection magnetic field distribution of a deflection coil.

For this reason, as the deflection frequency of electron beams becomes, it is strongly required to make higher the accuracy of a winding distribution of a deflection coil higher.

FIGS. 1A to 1H are schematic views showing a coil winding procedure for producing a saddle type deflection coil by using a related art coil winding machine.

First, as shown in FIG. 1A, a nozzle 52 placed inside a coil bobbin 51 is moved up along the inner peripheral surface of the coil bobbin 51 while feeding out a conducting wire W.

As shown in FIG. 1B, at a position near an opening of the nozzle 52, which has been moved above the coil bobbin 51, an upper hook 53 is turned into a "close" position to catch the conducting wire W by the tip of the hook 53.

The hook 53 is then moved outside the coil bobbin 51 while the conducting wire W is fed out of the nozzle 52.

As shown in FIG. 1C, the coil bobbin 51 is rotated, to wind the conducting wire W in a circumferential guide groove (not shown) of the coil bobbin 51.

When the winding angle of the conducting wire W reaches a specific angle, the rotation of the coil bobbin 51 is stopped, and, in this state, the hook 53 is turned into an "open" position to release the conducting wire W from the tip of the hook 53.

As shown in FIG. 1D, inside the coil bobbin 51, the nozzle 52 is moved down along the inner peripheral surface of the coil bobbin 51 while feeding out the conducting wire W.

As shown in FIG. 1E, at a position near the opening of the nozzle 52, a lower hook 54 is turned into the close position to catch the conducting wire W by the tip of the hook 54.

As shown in FIG. 1F, the hook 54 is moved outside the coil bobbin 51 while the conducting wire W is fed out of the nozzle 52.

Then, as shown in FIG. 1G, the coil bobbin 51 is rotated in the direction reversed to the rotational direction at the step shown in FIG. 1C, to wind the conducting wire W in the circumferential guide groove (not shown) of the bobbin 51.

When the winding angle of the conducting wire W reaches a specific angle, the rotation of the coil bobbin 51 is stopped.

In such a state, the hook 54 is turned into the open position to release the conducting wire W from the tip of the hook 54.

The conducting wire W has been thus wound by one turn.

Next, the nozzle 52 is moved up again, as shown in FIG. 1H. After that, the above-described operation is repeated while the winding position of the conducting wire W on the inner peripheral side of the coil bobbin 51 is sequentially shifted in the circumferential direction of the coil bobbin 51.

In this way, the conducting wire W for a deflection coil is wound around the coil bobbin 51 in a saddle type.

The above-described related art coil winding machine performs, as shown in FIG. 2, the operation of catching the conducting wire W by the tip of the hook 53 and the operation of releasing the conducting wire W from the tip of the hook 53 by turning the hook 53 in direction A into the open position and the close position, respectively.

Accordingly, upon feeding the conducting wire W having been wound in the circumferential guide groove 56 of the coil bobbin 51 in one of slits 58 formed by a plurality of ribs 57, it is required to ensure an operational space S for turning the hook 53 into the open position.

To be more specific, the conducting wire W is released from the hook 53 at a position P2 offset from a position P1, at which the conducting wire W is to be finally placed, by an amount equivalent to the operational space S in the direction from inside to outside of the coil bobbin 51.

Accordingly, the movement of the conducting wire W is not restricted in a distance L between the position P1 at which the conducting wire W is to be finally placed and the position P2 at which the conducting wire W is released from the hook 53.

As a result, after the winding of the conducting wire W is completed, as shown in FIG. 3, there occur variations in winding position between the conducting wire W portions wound in each slit 58 in the circumferential guide groove 56. This makes it very difficult to increase the accuracy of a winding distribution of the deflection coil.

On the other hand, the winding of the conducting wire W on the coil bobbin 51 can be performed only by operation of the nozzle 52 without use of the above-described hook 53; however, in this case, the coil bobbin 51 itself must have the function of guiding the conducting wire W.

As a result, the force applied to each rib 57 formed on the coil bobbin 51 becomes larger.

In particular, upon feeding the conducting wire W to each slit 58, as shown in FIG. 4, the conducting wire W withdrawn on the inner peripheral side of the coil bobbin by the nozzle 52 is brought into contact with the tip of the corresponding rib 57, to apply a large moment load on the contact portion (tip of the rib 57).

As a result, during the winding operation, there may occur the inconvenience that the rib 57 will be broken.

To cope with such an inconvenience, if the wall thickness of each rib 57 is made larger to increase the mechanical strength of the rib 57, the width of the slit 58 becomes narrower, to limit the winding position of the conducting wire W in the slit 58, thereby making it impossible to adjust finely the winding distribution.

Further, in the winding method making use of only the nozzle 52, the winding of the conducting wire W in the circumferential guide groove 56 of the coil bobbin 51 is performed in such a manner that a conducting wire W portion is stacked on the conducting wire W portion previously wound.

Accordingly, after the conducting wire W portions are stacked to some extent in the diameter direction of the coil bobbin 51, there may occur a phenomenon, called "disintegration of winding", in which when the next conducting wire W portion is wound, the stack of the conducting wire W portions previously wound is disintegrated.

As a result, like the winding method using the hook 53, after the winding of the conducting wire W is completed, there occur variations in winding position between the conducting wire W portions wound in each slit.

SUMMARY OF THE INVENTION

An object of the present invention is to provide a coil winding machine capable of increasing the accuracy of the winding distribution of a deflection coil and a method of producing a deflection coil by using the coil winding machine.

To achieve the above object, according to a first aspect of the present invention, there is provided a coil winding machine including: bobbin holding means for holding a coil bobbin having at each end portion a circumferential guide groove; a nozzle for feeding out a conducting wire for a deflection coil, the nozzle being movable along the inner peripheral surface of the coil bobbin in the center axis direction of the coil bobbin held by the bobbin holding means; and a winding guide having a tip portion movable in and out of the circumferential guide groove of the coil bobbin, the tip portion having a stepped portion capable of being engaged/disengaged with/from the conducting wire due to the relative positional relationship between the stepped portion and the nozzle in the center axial direction of the coil bobbin and a guide portion for restricting the feeding position of the conducting wire released from the stepped portion.

In the winding machine having the above configuration, a conducting wire fed out of the nozzle is engaged with the stepped portion of the winding guide and simultaneously the conducting wire is wound in the circumferential guide groove of a coil bobbin. The tip portion of the winding guide is then advanced in the circumferential guide groove of the coil bobbin, and the tip portion of the winding guide faces to a position at which the conducting wire is to be finally placed.

By moving, in such a state, the nozzle from one end to the other end of the coil bobbin in the center axis thereof, the relative positional relationship between the winding guide and the nozzle in the center axis direction of the coil bobbin is inverted, and thereby a drawing force is applied obliquely downward to the conducting wire engaged with the stepped portion of the winding guide.

The conducting wire is thus automatically released from the stepped portion of the winding guide, and, accordingly, upon advance of the tip portion of the winding guide in the circumferential guide groove of the coil bobbin, it is not required to ensure an operational space for releasing the conducting wire.

The conducting wire thus released from the stepped portion of the winding guide can be fed to the position at which the conducting wire is to be finally placed by guiding the conducting wire by the guide portion provided on the tip portion of the winding guide.

According to a second aspect of the present invention, there is provided a method of producing a deflection coil by using a coil winding machine, the coil winding machine including bobbin holding means for holding a coil bobbin having at each end portion a circumferential guide groove, a nozzle for feeding out a conducting wire for a deflection coil, the nozzle being movable along the inner peripheral surface of the coil bobbin in the center axis direction of the coil bobbin held by the bobbin holding means, and a winding guide having a tip portion movable in and out of the circumferential guide groove of the coil bobbin, the tip portion having a stepped portion capable of being engaged/disengaged with/from the conducting wire due to the relative positional relationship between the stepped portion and the nozzle in the center axial direction of the coil bobbin and a guide portion for restricting the feeding position of the conducting wire released from the stepped portion, and the method including the steps of engaging the conducting wire fed out of the nozzle with the stepped portion of the winding guide and simultaneously winding the conducting wire in the circumferential guide groove of the coil bobbin, and releasing the conducting wire from the stepped portion of the winding guide by moving the tip portion of the winding guide in the circumferential guide groove of the coil bobbin and moving the nozzle from one end to the other end of the coil bobbin in the center axis direction of the coil bobbin.

With this configuration, it is possible to feed the conducting wire released from the stepped portion of the winding guide up to the position at which the conducting wire is to be finally placed by guiding the conducting wire by the guide portion provided on the tip portion of the winding guide.

Accordingly, it is possible to prevent the occurrence of disintegration of the winding of the conducting wire and hence to produce a deflection coil with a high accuracy.

DETAILED DESCRIPTION OF THE PREFERRED EMBODIMENT

Hereinafter, an embodiment of the present invention will be described in detail with reference to the accompanying drawings.

Figure 5:
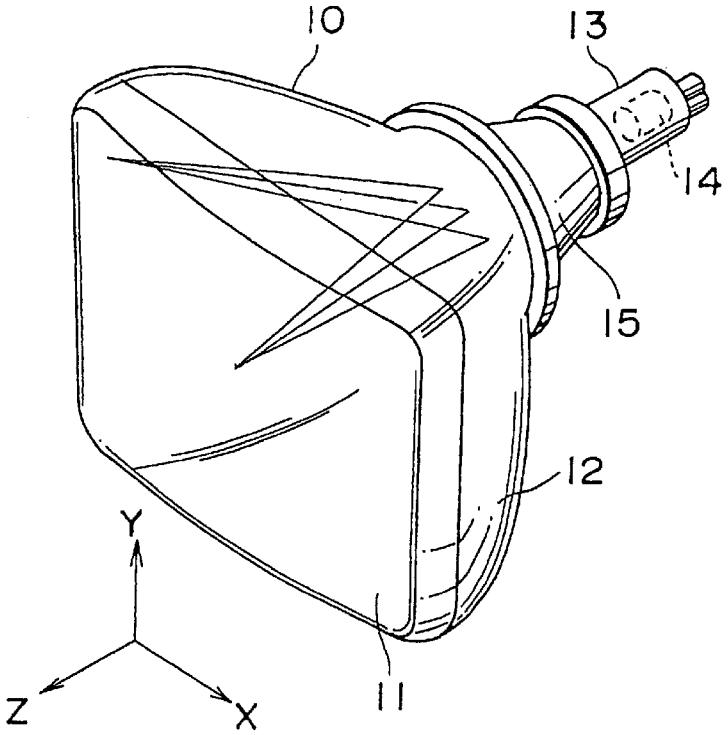
FIG. 5 is a schematic perspective view showing an entire configuration of a CRT.

FIG. 5 is a schematic perspective view showing an entire configuration of a CRT.

Referring to FIG. 5, a CRT 10 includes a panel portion 11, a funnel portion 12, and a neck portion 13.

A phosphor screen (not shown), on which phosphors of red, blue, and green are arrayed, is formed on the inner surface of the panel portion 11.

An electron gun 14 for emitting electron beams is built in the neck portion 13.

A deflection yoke 15 is mounted on a portion (cone portion) extending from the neck portion 13 to the funnel portion 12.

Figure 6:
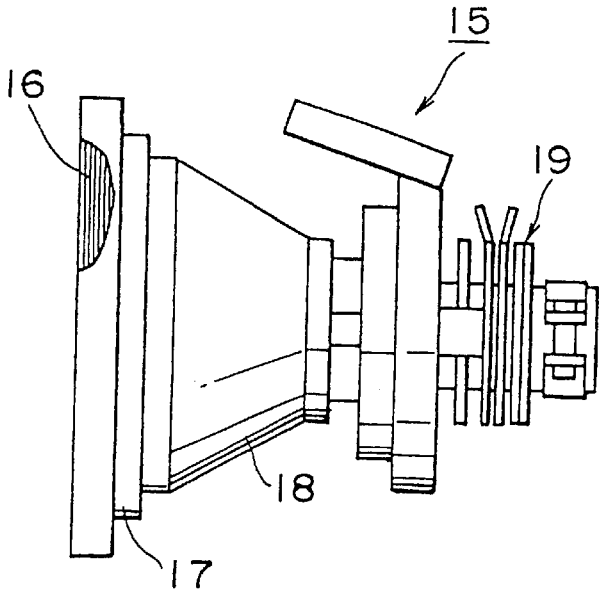
FIG. 6 is a side view of a deflection yoke, with parts partially cutaway.

The deflection yoke 15 includes, as shown in FIG. 6, a horizontal deflection coil 16, a vertical deflection coil 17, a core 18, a ring magnet 19, and the like. The horizontal deflection yoke 16 is wound on a coil bobbin in a saddle type.

The vertical deflection yoke 17 is wound, for example, on a coil bobbin different from that used for the horizontal deflection yoke 16, in a saddle type.

To be more specific, a pair of the horizontal deflection yokes 16 are disposed on upper and lower parts, divided in the vertical axis direction, of the deflection yoke 15, and a pair of the vertical deflection yokes 17 are disposed on right and left parts, divided into the horizontal axis direction, of the deflection yoke 15.

On the trajectories of electron beams emitted from the electron gun 14, the horizontal deflection coils 16 generate a magnetic field for deflecting the electron beams from side to side (in the horizontal axis direction) of the screen, and the vertical deflection coils 17 generate a magnetic field for deflecting the electron beams up and down (in the vertical axis direction) of the screen.

The core 18, which is made from a magnetic material such as a ferrite, is mounted to cover the horizontal deflection coil 16 and the vertical deflection coil 17 in order to enhance the efficiency of the magnetic fields generated by the deflection coils 16 and 17.

The ring magnet 19 is mounted on a rear-end portion of the deflection yoke 15 in order to correct the deviations in trajectories of electron beams due to an assembly error of the electron gun 14 and the like.

Figure 7:
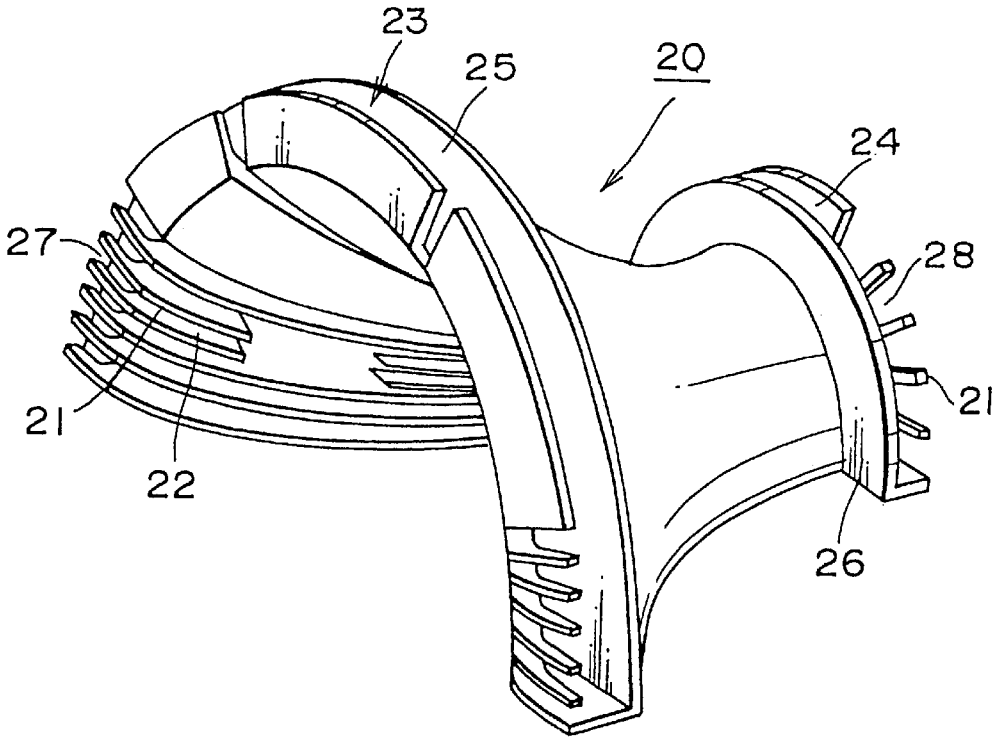
FIG. 7 is a perspective view showing a structure of coil bobbin.
Figure 8:
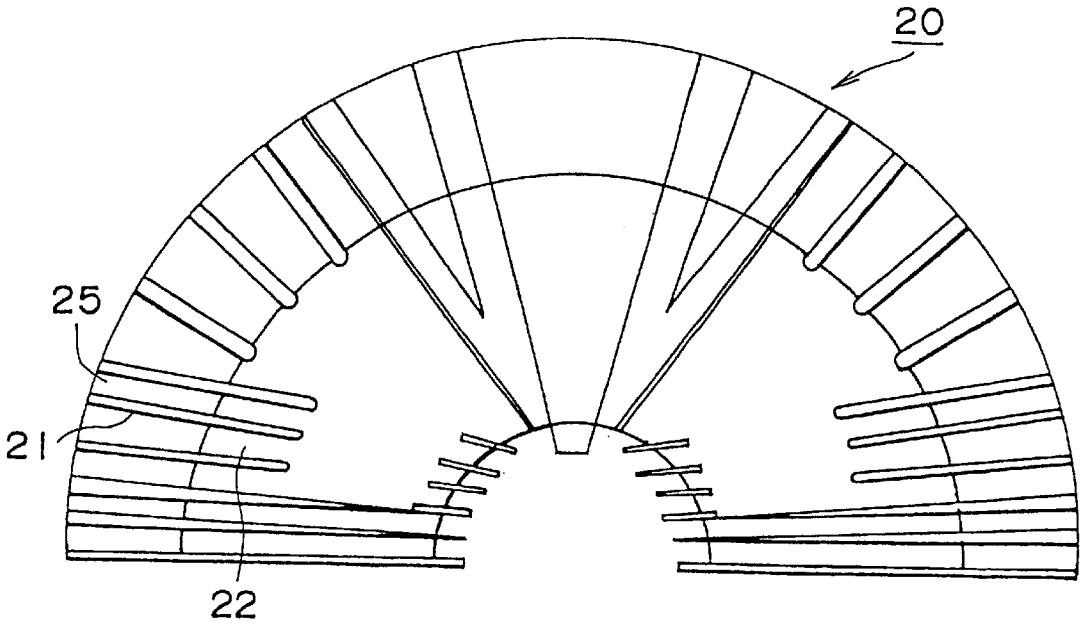
FIG. 8 is a front view showing the structure of the coil bobbin.

FIG. 7 is a perspective view showing one example of a coil bobbin on which a conducting wire for a horizontal deflection coil or vertical deflection coil is to be wound in a saddle type; and, FIG. 8 is a front view of the coil bobbin shown in FIG. 7.

Referring to FIGS. 7 and 8, a plurality of ribs 21, which extend from one end to the other end of a coil bobbin 20 in the center axis direction thereof, are projectingly formed on the inner peripheral side of the coil bobbin 20.

Winding guide grooves 22, each of which is formed between adjacent two of the plurality of ribs 21, are formed on the inner peripheral surface of the coil bobbin 20.

Both end portions of each of the plurality of ribs 21 are bent along the diameter direction of the coil bobbin 20 at both ends of the coil bobbin 20.

Circumferential guide grooves 23 and 24 for allowing a conducting wire for a deflection coil to extend in a circular-arc shape along the circumferential direction are formed at both ends of the coil bobbin 20.

The circumferential guide grooves 23 and 24 are formed by flanges 25 and 26 formed on the outer peripheral portions at both ends of the coil bobbin 20 and the end portions, bent at both the ends of the coil bobbin 20, as described above, of the plurality of ribs 21, respectively.

At both ends of the coil bobbin 20, slits 27 and 28 communicated to the circumferential guide grooves 23 and 24, respectively, are each formed between two adjacent end portions, bent at both the ends of the coil bobbin 20, of the plurality of ribs 21.

The coil bobbin 20 shown in the figures is integrally assembled with a coil bobbin having the same structure, to be formed into an approximately circular truncated cone shape.

Figure 9:
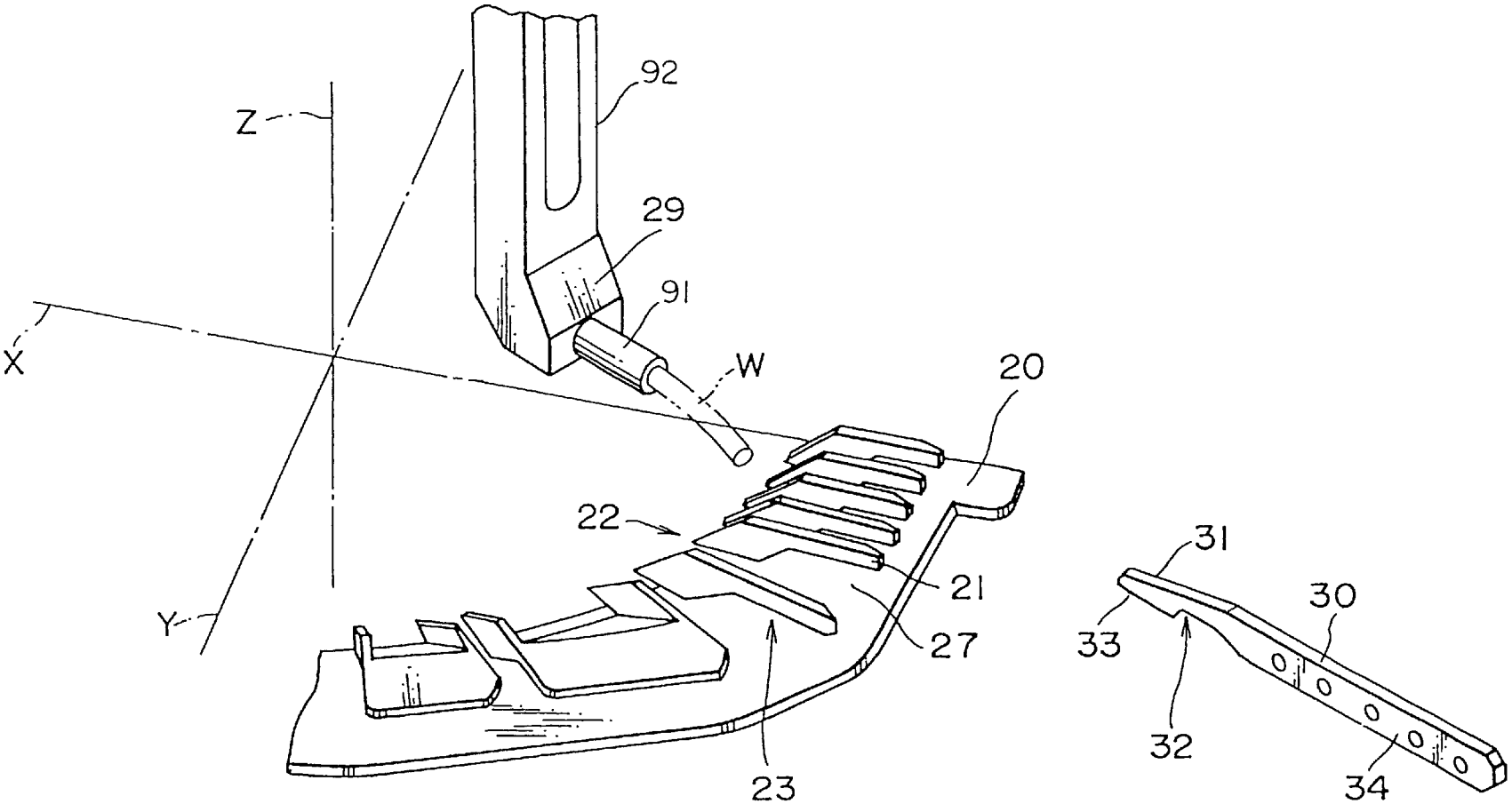
FIG. 9 is a perspective view showing an essential portion of a coil winding machine of the present invention.

FIG. 9 is a perspective view showing an essential portion of a coil winding machine according to one embodiment of the present invention.

Figure 11:
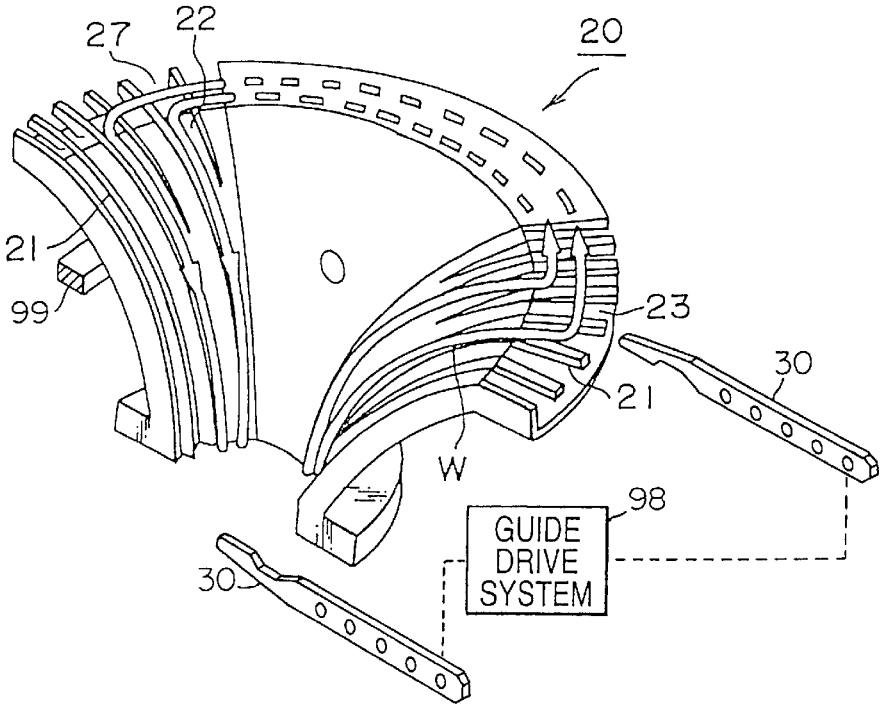
FIG. 11 is a perspective view of a coil bobbin on which a conducting wire is wounded.

Referring to FIG. 9, a coil bobbin 20 on which a conducting wire is to be wound is upright positioned with its one end (opening) directed upwardly and is held in this state by a bobbin holding device, for example, a rotary table 99 illustrated in FIG. 11.

A nozzle 29 and a winding guide 30 for carrying out winding works are disposed near the coil bobbin 20 thus held by the rotary table.

In the figure, the z-axis designates the center axis of the coil bobbin 20, and the x-axis and y-axis designate two axes perpendicular to each other on the z-axis.

The nozzle 29 has a conducting wire feed-out portion 91 for feeding out a conducting wire W for a deflection coil to be wound on the coil bobbin 20 in a saddle type and a nozzle main body 92 for supporting the conducting wire feed-out portion 91.

The conducting wire feed-out portion 91 is formed into a cylindrical shape, and the nozzle main body 92 is formed into an arm shape.

The nozzle 29 is configured such that the conducting wire W to which a tension is applied by tension applying means (not shown) is fed from the nozzle main body 92 to the outside through the conducting wire feed-out portion 91.

The nozzle 29 is movably supported by a nozzle drive system (not shown).

The nozzle drive system has two drive mechanisms capable of moving the nozzle 29 in both the center axis direction and the radial direction of the coil bobbin 20.

The nozzle 29 can be moved up and down along the inner peripheral surface of the coil bobbin 20 in the center axis direction (z-axis direction) of the coil bobbin 20 by operating the two drive mechanisms in combination with each other.

The winding guide 30 is disposed outside the coil bobbin 20 in such a manner as to face slightly oblique to the conducting wire feed-out portion 91 of the nozzle 29.

The winding guide 30 is movably supported by a conventional guide drive system 98 shown diagrammatically in FIG. 11.

The guide drive system has two drive mechanisms capable of moving the winding guide 30 in both the center axis direction (z-axis direction in the figure) and the radial direction of the coil bobbin 20.

Figure 10A:
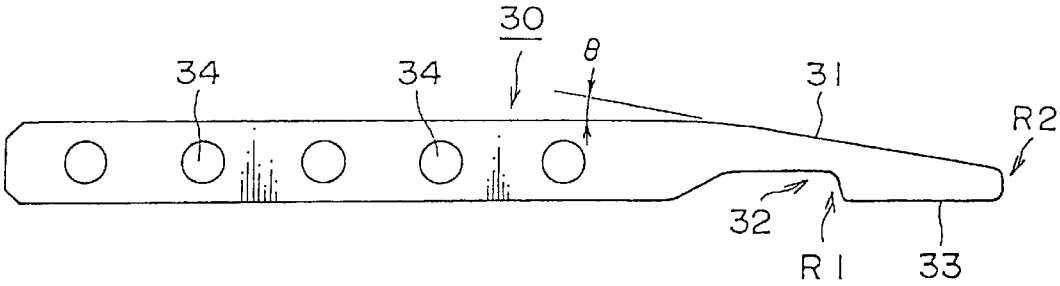
FIGS. 10A and 10B are views illustrating a structure of a winding guide used for the coil winding machine of the present invention.
Figure 10B:
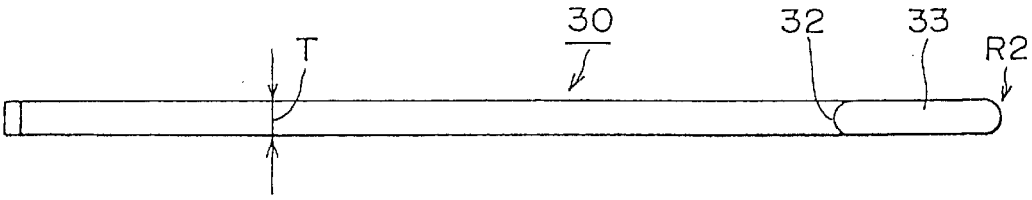

As shown in a side view of FIG. 10A and a bottom view of FIG. 10B, the winding guide 30 is formed into a flat bar shape as a whole.

The winding guide 30 has, at its tip portion, a taper portion 31, a stepped portion 32, and a guide portion 33.

The taper portion 31 is formed on the upper side of the winding portion 30 while being tilted at a specific angle θ (for example, 74 ≈10° ) with respect to the upper side. With the formation of the taper portion 31, the shape of the tip portion of the winding guide 30 becomes approximately a wedge shape.

A thickness T of the winding guide 30 is set smaller than the width of each of the slits 27 and 28 formed at both the ends of the coil bobbin 20.

The stepped portion 32 and the guide portion 33 are formed on the lower side (opposed to the side on which the taper portion 31 is formed) of the winding guide 30.

The stepped portion 32 is formed by partially cutting the lower side portion of the winding guide 30 into a recessed shape.

The guide portion 33 extends approximately in parallel to the lower side of the winding guide 30 in such a manner as to connect continuously the stepped portion 32 to the tip of the winding guide 30.

A corner portion R1 between the stepped portion 32 and the guide portion 33 and a corner portion R2 at the tip of the winding guide 30 are each formed into a rounded surface shape.

The surfaces of the taper portion 31, stepped portion 32, and guide portion 33 are each finished into a smoothly rounded surface by, for example, buffing.

The remaining portion, other than the above-described tip portion, of the winding guide 30 has a plurality of mounting holes (through-holes) 34 spaced from each other at specific intervals in the longitudinal direction of the winding guide 30.

These mounting holes 34 are used for fixing the winding guide 30 to the above-described guide drive system (not shown) by, for example, screwing.

In the case of fixing the winding guide 30 to the guide-drive system, it is not required to use all of the mounting holes 34. To be more specific, the mounting position of the winding guide 30 to the guide drive system can be suitably adjusted in accordance with the size of a coil bobbin by selecting those, necessary for fixing the winding guide 30 from the plurality of mounting holes 34.

Next, a method of producing a deflection coil by using the coil winding machine having the above-described configuration will be described with reference to FIGS. 11, 12 and 13.

Referring to FIG. 11, on the inner peripheral side extending from one end to the other end of the coil bobbin 20, the conducting wire W for a deflection coil is guided in the winding guide grooves 22 formed between the ribs 21; and, at each of both the ends of the coil bobbin 20, the conducting wire W is made to pass through each slit 27 (or 28) and is guided in the circumferential guide groove 23 (or 24). The conducting wire W is thus wound on the coil bobbin 20 in a saddle type.

The coil bobbin 20, on which the conducting wire W has been wound as described above, is shown in FIG. 11.

Each of the steps of winding of the conducting wire W according to the present invention will be described below.

First, like the related art method, the nozzle 29 is moved up along the inner peripheral surface of the coil bobbin 20 by the nozzle drive system (not shown) while feeding out the conducting wire W on the inner peripheral side of the coil bobbin 20.

The conducting wire W is thus drawn upwardly from the coil bobbin 20 in a state being engaged in a specific winding guide groove 22 on the inner peripheral surface of the coil bobbin 20.

The winding guide 30 then is operated by the guide drive system. To be more specific, the winding guide 30 is moved inside the coil bobbin 20 near the nozzle 29 and is moved down to depress, from above, the conducting wire W fed out of the nozzle 29 by the guide drive system.

At this time, the tip portion of the winding guide 30 is brought into contact with the conducting wire W in a state in which the winding guide 30 crosses the conducting wire W, and in such a contact state, the winding guide 30 is moved down, whereby the conducting wire W is engaged with the stepped portion 32 of the winding guide 30.

Then, while the conducting wire W is fed out of the nozzle 29, the winding guide 30 is retreated outwardly of the coil bobbin 20 and is moved down to a height position at which the tip portion of the winding guide 30 faces to the circumferential guide groove 23 of the coil bobbin 20.

With this operation, the conducting wire W passes through the slit 27 positioned between the ribs 21 of the coil bobbin 20.

Subsequently, the coil bobbin 20 is rotated by the rotary table (not shown).

The conducting wire W is thus wound in the circumferential guide groove 23 of the coil bobbin 20 while being left engaged with the stepped portion 32 of the winding guide 30.

It should be noted that the conducting wire W may be wound in the circumferential guide groove 23 by moving both the nozzle 29 and the winding guide 30 along the outer periphery of the coil bobbin 20 while leaving the coil bobbin 20 fixed.

When the winding angle of the conducting wire W in the circumferential guide groove 23 reaches a specific angle, the rotation of the rotary table on which the coil bobbin 20 is held is stopped, and, in this state, the tip portion of the winding guide 30 is advanced in the circumferential guide groove 23 by guide drive system.

With this operation, the tip portion of the winding guide 30 reaches a position at which the conducting wire W is to be finally placed. This state is shown in FIG. 12.

Figure 12:
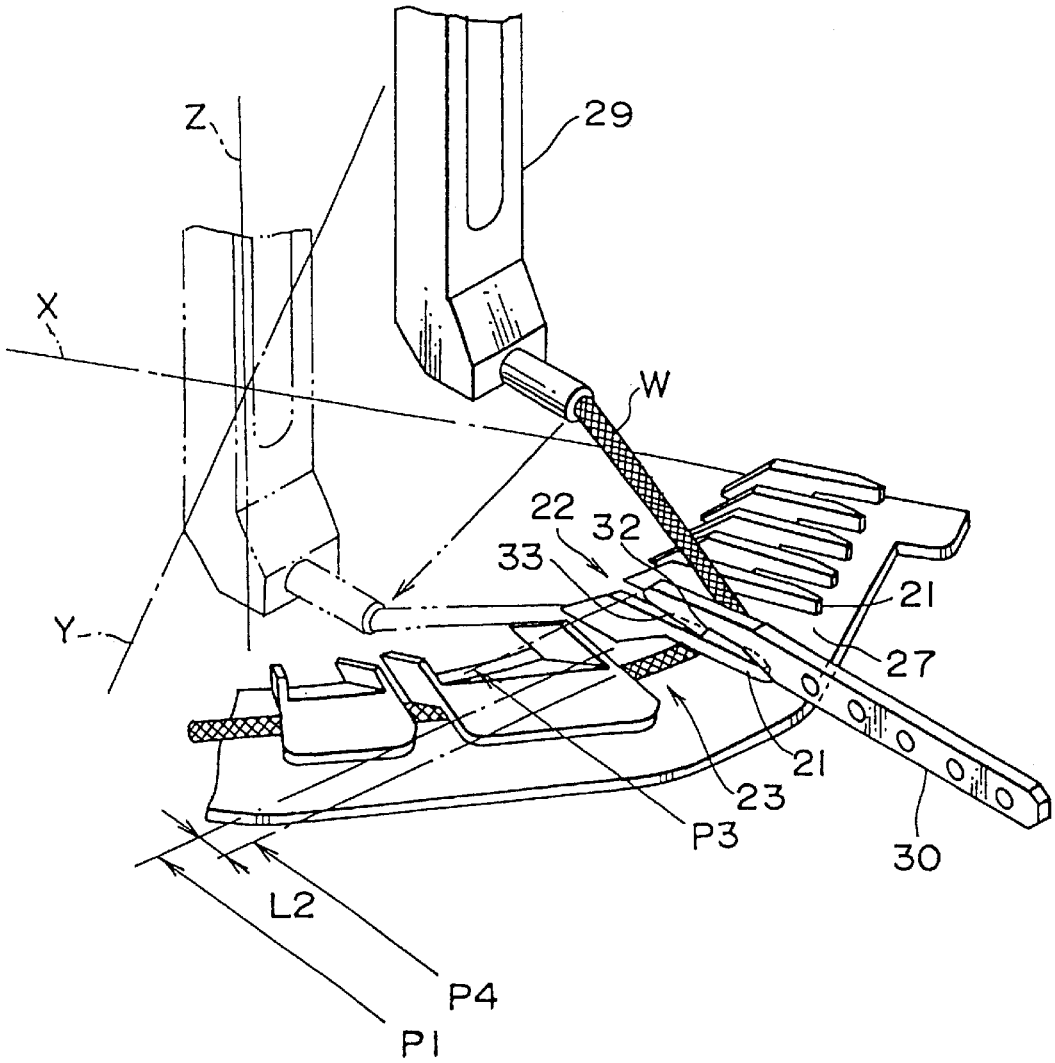
FIG. 12 is a view illustrating a method of producing a deflection coil according to the present invention.

Referring to FIG. 12, in the circumferential guide groove 23 of the coil bobbin 20, the tip portion of the winding guide 30 is inserted toward the winding guide groove 22 communicated to the slit 27 between the ribs 21.

Further, as shown in FIG. 12, the tip of the winding guide 30 is advanced up to a position P3, which is deeper than the position at which the conducting wire W is to be finally placed, that is, the root portion P1 of the rib 21.

In this case, since the tip portion of the winding guide 30 is formed into an approximately wedge shape, even if a plurality of winding wire W portions have been already wound in the circumferential guide groove 23, the tip portion can be advanced as deep as possible without positional interference with the conducting wire W portions.

When, in such a state, the nozzle 29 is moved down toward the other end of the coil bobbin 20, as shown by a two-dot chain line, the relative positional relationship between the winding guide 30 and the nozzle 29 in the center axis direction, that is, the z-axis direction of the coil bobbin 20, is inverted.

To be more specific, the nozzle 29 is disposed above the winding guide 30 before the nozzle 29 is moved down; however, as the nozzle 29 is moved down, the nozzle 29 is positioned under the winding guide 30, that is, the relative positional relationship in the vertical direction between the winding guide 30 and the nozzle 29 is inverted in the middle of downward movement of the nozzle 29.

Along with the inversion of the relative positional relationship between the winding guide 30 and the nozzle 29, a drawing force is applied obliquely downward to the conducting wire W engaged with the stepped portion 32 of the winding guide 30.

As a result, the conducting wire W is automatically released from the stepped portion 32 of the winding guide 30.

The conducting wire W, thus released from the stepped portion 32, is fed to the position P1, at which the conducting wire W is to be finally placed, along the guide portion 33 continuous from the stepped portion 32.

At this time, the conducting wire W is released from the stepped portion 32 at a position P4 offset from the position P1, at which the conducting wire W is to be finally placed, in the direction from inside to outside of the coil bobbin 20; however, the position of the conducting wire W is restricted by the guide portion 33 of the winding guide 30 in the route (distance L2) between the release position P4 and the position P1 at which the conducting wire W is to be finally placed.

After that, the downward movement of the nozzle 29 is continued, and simultaneously the winding guide 30 is retreated outwardly of the coil bobbin 20.

On the other end side of the coil bobbin 20, the conducting wire W is wound in the circumferential guide groove 24 shown in FIG. 7 by using a winding guide having the same structure as that of the winding guide 30.

The conducting wire W has been thus wound by one turn, and the nozzle 29 is moved up again on the inner peripheral side of the coil bobbin 20. After that, the above-described operation is repeated while the winding position of the conducting wire W is sequentially shifted in the circumferential direction of the coil bobbin 20, whereby the conducting wire W for a deflection coil is wound around the coil bobbin 20 in a saddle type.

In this way, according to this embodiment, the conducting wire W fed out of the nozzle 29 is engaged with the stepped portion 32 of the winding guide 30, wound in the circumferential guide groove 23 of the coil bobbin, and automatically released from the stepped portion 32 of the winding guide 30 by advancing the tip portion of the winding guide 30 in the circumferential guide groove 23 and moving down the nozzle 29.

The conducting wire W released from the stepped portion 32 is fed to position P1, at which the conducting wire W is to be finally placed, by guiding the conducting wire W by the guide portion 33.

As a result, since the conducting wire W released from the winding guide 30 can be positioned accurately at the desired winding position in the slit 27 of the coil bobbin 20, it is possible to reduce significantly variations in winding position between the winding wire W portions wound in the slit 27 as compared with the variations in winding position obtained by winding method of the related art.

Figure 13:
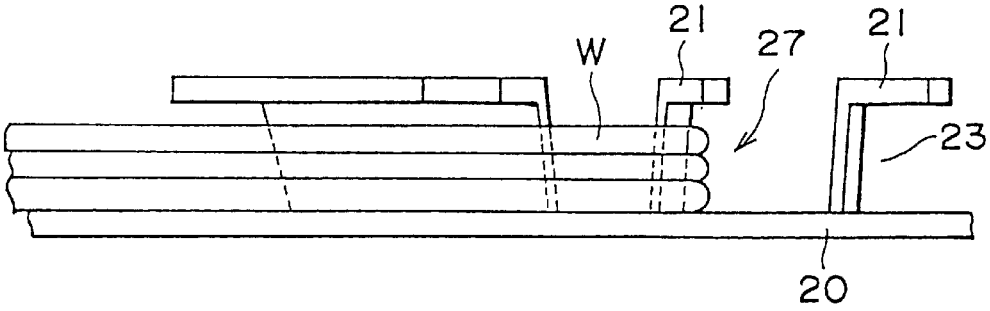
FIG. 13 is a view showing a winding state of a conducting wire obtained by using the coil winding machine of the present invention.

For example, according to this embodiment, the winding wire W portions can be wound in the slit 27 in alignment with each other, as shown in FIG. 13.

This makes it possible to increase the accuracy of the winding distribution of the deflection coil and, hence, to produce a deflection coil having a fixed coil characteristic.

The conducting wire W can be released from the winding guide 30 only by downward movement of the nozzle 29 while the position of the winding guide 30 is left fixed.

Figures 1A, 1B, 1C, 1D, 1E, 1F, 1G, 1H:
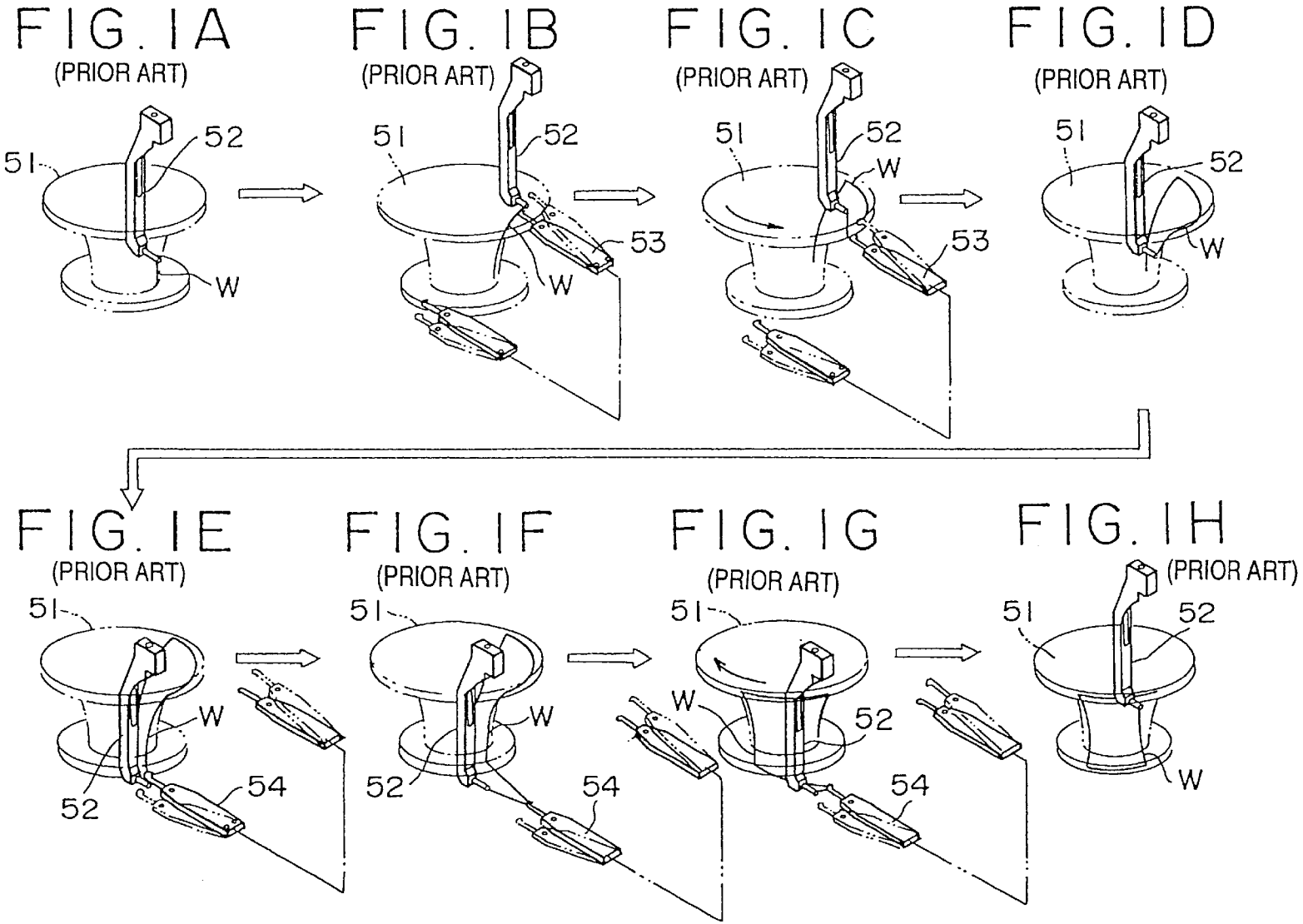
FIG. 1A (PRIOR ART)
FIG. 1B (PRIOR ART)
FIG. 1C (PRIOR ART)
FIG. 1D (PRIOR ART)
FIG. 1E (PRIOR ART)
FIG. 1F (PRIOR ART)
FIG. 1G (PRIOR ART)
FIG. 1H (PRIOR ART)
FIGS. 1A to 1H are schematic views showing a coil winding procedure using a related art coil winding machine.
Figure 2:
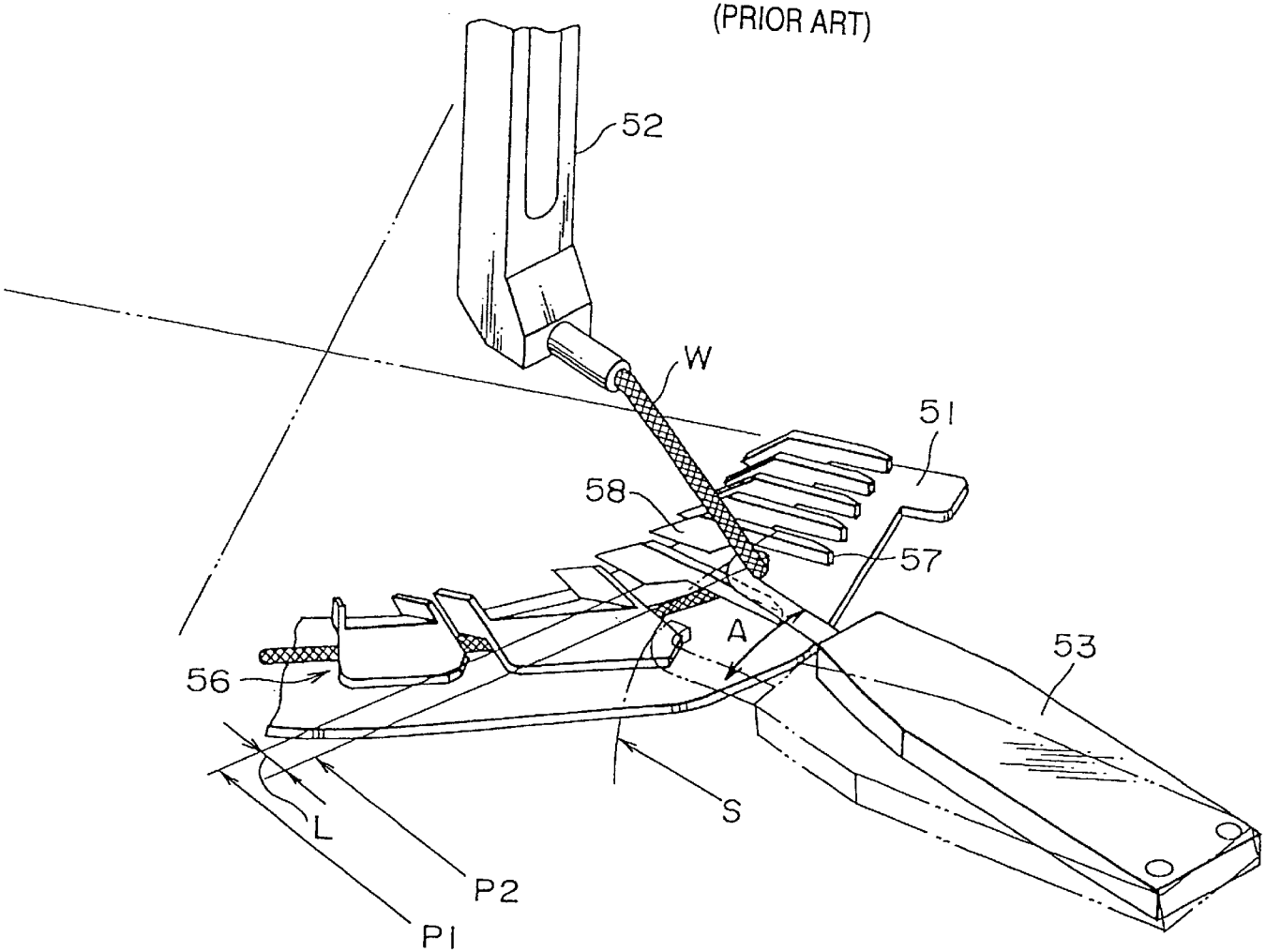
FIG. 2 (PRIOR ART)
FIG. 2 is a view illustrating an operation of releasing a conducting wire by the related art coil winding machine.
Figure 3:
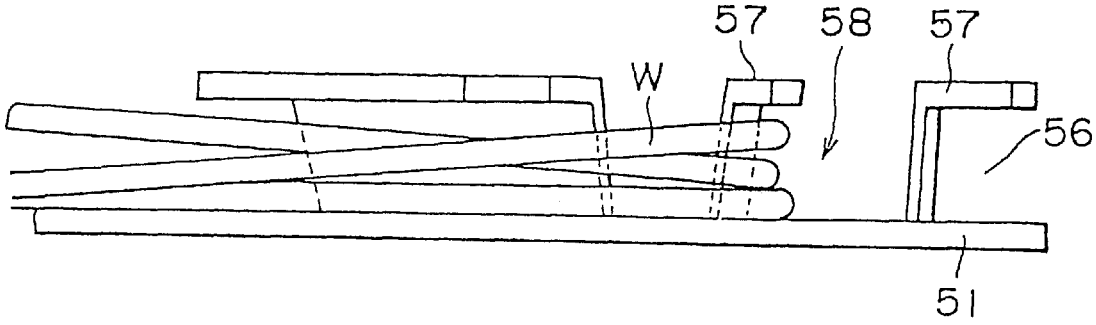
FIG. 3 (PRIOR ART)
FIG. 3 is a view showing a winding state of a conducting wire obtained by using the related art coil winding machine;.

This makes it possible to eliminate the operation of turning the hook into the open position or close position, which has been required for the related art coil winding machine shown in FIG. 2.

As a result, it is possible to carry out the works of winding the conducting wire W on the coil bobbin 20 at a higher speed and, hence, to improve productivity.

Further, it is possible to eliminate the need for providing a drive system for turning the hook into the open position or close position and, hence, to simplify the mechanism of the coil winding machine.

According to this embodiment, since the thickness T of the winding guide 30 is set smaller than the width of the slit 27 or 28 of the coil bobbin 20 in order to allow the tip portion of the winding guide 30 to pass smoothly through the slit 27 or 28, when the conducting wire W is released from the stepped portion 32 of the winding guide 30, it is possible to feed the conducting wire W at an arbitrary position in the width direction of the circumferential guide groove 23 without any positional interference between the ribs 21 and the winding guide 30.

It should be noted that if the thickness T of the winding guide 30 is set larger than the width of the slit 27 or 28, it is possible to achieve the target object (high accuracy of a winding distribution).

Figure 4:
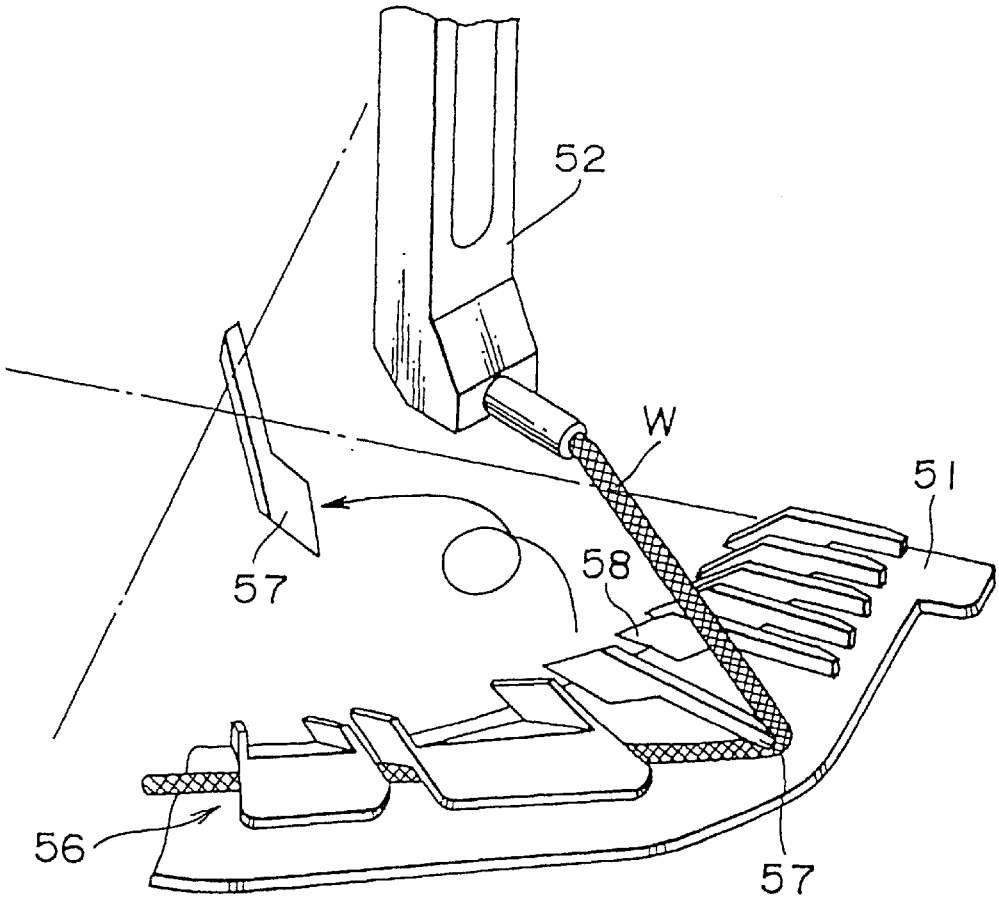
FIG. 4 (PRIOR ART)
FIG. 4 is a view showing another related art coil winding method.

In the case where the conducting wire W is wound on the coil bobbin only by operation of the nozzle, as shown in FIG. 4, it may be considered that the coating of the conducting wire W is affected by the friction of the conducting wire with the rib.

According to the coil winding machine, however, since the conducting wire W fed out of the nozzle 29 is wound while being guided by the winding guide 30, it is possible to prevent the conducting wire W from being damaged.

This contributes to the production of a deflection coil having a high reliability.

As described above, the winding method according to the present invention involves engaging a conducting wire fed out of the nozzle with the stepped portion of the winding guide and winding the conducting wire in the circumferential guide groove of the coil bobbin, automatically releasing the conducting wire from the stepped portion of the winding guide by advancing the tip portion of the winding guide in the circumferential guide groove of the coil bobbin and by moving the nozzle from one end to the other end of the coil bobbin in the center axis direction thereof, and feeding the conducting wire thus released to a position at which the conducting wire is to be finally placed by guiding the conducting wire by the guide portion of the winding guide.

As a result, it is possible to reduce significantly the variations in winding position between the conducting wire portions and, hence, to increase the accuracy of the winding distribution of a deflection coil.

Further, it is possible to produce a deflection coil having a fixed-coil characteristic.

Additionally, since the accuracy of the winding distribution is increased, it is possible to eliminate the need for providing a complicated correction circuit or performing difficult adjusting work.

What is claimed is:

1. A coil winding machine comprising:

bobbin holding means for holding a coil bobbin, the coil bobbin including an inner peripheral surface defining a central bore and two end portions with each end portion having a circumferential guide groove formed therein, each end portion defining a respective opening into the central bore;

a nozzle for feeding out a conducting wire for a deflection coil, said nozzle being movable along and through the central bore of said coil bobbin in a center axis direction of said coil bobbin held by said bobbin holding means; and a winding guide having at least one winding guide member formed with a tip portion and movable in and out of said circumferential guide groove of said coil bobbin and having a recess forming a stepped portion wherein, when the nozzle moves in the center axis direction outwardly through the opening from the central bore, the stepped portion captures the conducting wire in the recess and, when the nozzle moves in the center axis direction through the opening and into the central bore, the conducting wire is released from the recess.

2. A coil winding machine according to claim 1, wherein said winding guide includes two winding guide members being configured independently from each other, respective ones of the winding guide members being disposed adjacent the openings.

3. A coil winding machine according to claim 1, wherein said stepped portion and said guide portion of said at least one winding guide member are connected to each other via a rounded corner portion.

4. A coil winding machine according to claim 1, wherein the winding guide includes a guide portion for restricting a feeding position of said conducting wire released from the recess.

5. A method of producing a deflection coil by using a coil winding machine, said coil winding machine including: bobbin holding means for holding a coil bobbin, the coil bobbin including an inner peripheral surface defining a central bore and two end portions with each end portion having a circumferential guide groove, formed therein, each end portion defining a respective opening into the central bore; a nozzle for feeding out a conducting wire for a deflection coil, said nozzle being movable along and through the central bore of said coil bobbin in a center axis direction of said coil bobbin held by said bobbin holding means; and a winding guide having at least one winding guide member formed with a tip portion and movable in and out of said circumferential guide groove of said coil bobbin and having a recess forming a stepped portion wherein, when the nozzle moves in the center axis direction outwardly through the opening from the central bore, the stepped portion captures the conducting wire in the recess and, when the nozzle moves in the center axis direction through the opening and into the central bore, the conducting wire is released from the recess; said method comprising the steps of:

engaging said conducting wire fed out of said nozzle with the recess formed by the stepped portion of said winding guide when the nozzle moves in the central axis direction outwardly from the central bore and simultaneously winding said conducting wire in the circumferential guide groove of said coil bobbin; and releasing said conducting wire from the recess of said winding guide by moving the tip portion of said winding guide in the circumferential guide groove of said coil bobbin and moving said nozzle from one opening to the other opening of said coil bobbin in the center axis direction of said coil bobbin.

* * * * *